US005078732A

United States Patent [19]

Ceniceros

[11] Patent Number: 5,078,732

[45] Date of Patent: Jan. 7, 1992

[54] ORAL HYGIENE DEVICE FOR YOUNG CHILDREN

[76] Inventor: Robert C. Ceniceros, 10 Hazel St., Larkspur, Calif. 94939

[21] Appl. No.: 505,892

[22] Filed: Apr. 6, 1990

[51] Int. Cl.[5] ..... A61J 17/00

[52] U.S. Cl. ..... 606/235; 434/263; 128/62 A

[58] Field of Search ..... 15/110; 128/62 A; 606/235; 434/263

[56] References Cited

U.S. PATENT DOCUMENTS

| | | | |
|---|---|---|---|
| D. 105,116 | 6/1937 | Love et al. | 128/62 A |
| 2,060,869 | 11/1936 | Hopkins | 434/263 |
| 3,720,975 | 3/1973 | Nelson | 128/62 A |
| 3,753,266 | 8/1973 | Ceniceros | 606/235 |
| 4,253,212 | 3/1981 | Fujita | 434/263 |

FOREIGN PATENT DOCUMENTS

| | | | |
|---|---|---|---|
| 2495908 | 6/1982 | France | 15/167.1 |
| 2067069 | 7/1981 | United Kingdom | 128/62 A |

*Primary Examiner*—Stephen C. Pellegrino
*Assistant Examiner*—Glenn K. Dawson
*Attorney, Agent, or Firm*—Robert Charles Hill

[57] ABSTRACT

The oral hygiene device of the present invention combines a tooth brush with a teething ring so that cognitive factors relating to oral hygiene education for caring for baby teeth are maximized.

12 Claims, 3 Drawing Sheets

ORAL HYGIENE DEVICE FOR YOUNG CHILDREN

SCOPE OF THE INVENTION

The present invention relates to an oral hygiene device combining a tooth brush with a teething ring and more particularly to an improved means and method of the above-described type in which cognitive factors related to oral hygiene education for caring for temporary baby teeth have been maximized in an environment emphasizing safe operations even though the improved oral device may be manipulated by an unattended young child.

BACKGROUND OF THE INVENTION

In my U.S. Pat. No. 3,753,266 for "EDUCATIONAL ORAL HYGIENE DEVICE FOR YOUNG CHILDREN" incorporated herein by reference, an oral hygiene device is described. The described hygiene device comprises a teething ring constructed with an actual bristle section of a tooth brush. Within the ring is a series of spokes radiating from the handle of the brush. Even though my invention, as described in aforemention patent, was extremely useful, it has been found over the long run to present a problem. Since the tooth brush extends beyond the circumferential surface of the teething ring, the bristles of the bristle section can undergo extensive wear and tear, be dislodged and thereby expose the end of the handle to the youngster's tender mouth. Note that teething of an infant starts at about 4 to 5 months and includes the emergence of back molars at about two years after birth.

SUMMARY OF THE INVENTION

The present invention includes a means and method to effect oral hygiene education aiding care and maintenance of baby teeth while emphasizing safe operation.

In one aspect, an improved oral hygiene device is described comprising a teething ring of annular shape having an outside diameter D1 defining an outer circumferential surface and a simulated tooth brush having a length L normal to the axis of symmetry. In order that the simulated tooth brush not extend beyond the circumference of the teething ring (to cause injury), L must be equal to or less than D1. The simulated tooth brush includes a handle of rectangular cross-section, an axis of symmetry normal to the central axis of symmetry of the teething ring, a bristle section integrally molded to the teething ring, and end segments connected to diametrically-opposed, parallel slots within the teething ring. Since the simulated tooth brush spans the interior cavity of the teething ring, there is defined a pair of crescent-shaped sectors of sufficient area to permit the hand of a youngster to penetrate through the sectors and grip the handle of the tooth brush. In that way, a youngster can mechanically manipulate the improved device of the present invention via the handle of the simulated tooth brush when the teething ring is being used as a teether. Result: associative factors are present that can be surprisingly used in later oral hygiene education related to cleaning and maintaining the youngster's baby teeth. In this regard, the simulated tooth brush is to be constructed of an appropriate size, shape and color that triggers and sustains pleasant memories when oral hygiene education is undertaken.

In another aspect, the youngster is provided with an actual tooth brush of similar size, shape and color as the simulated tooth brush. He is also encouraged to carry the improved oral hygiene device with him during play or waking rest periods. Cognitive recognition between functions of the separate tooth brushes are thus established. Mechanics of good brushing is then taught (by the teacher using the actual brush to clean the youngster's teeth). Through repetition and reinforcement coupled with dexterity improvement through the toting of the improved device of the present invention augmented by the similarities of color, size and shape of the two brushes, a life long habit of good oral hygiene can be firmly established.

DESCRIPTION OF AN PREFERRED EMBODIMENT

In order to aid a youngster to care for his temporary baby teeth, the present invention includes a means and method to effect oral hygiene education while emphasizing safe operation.

Figure 1:
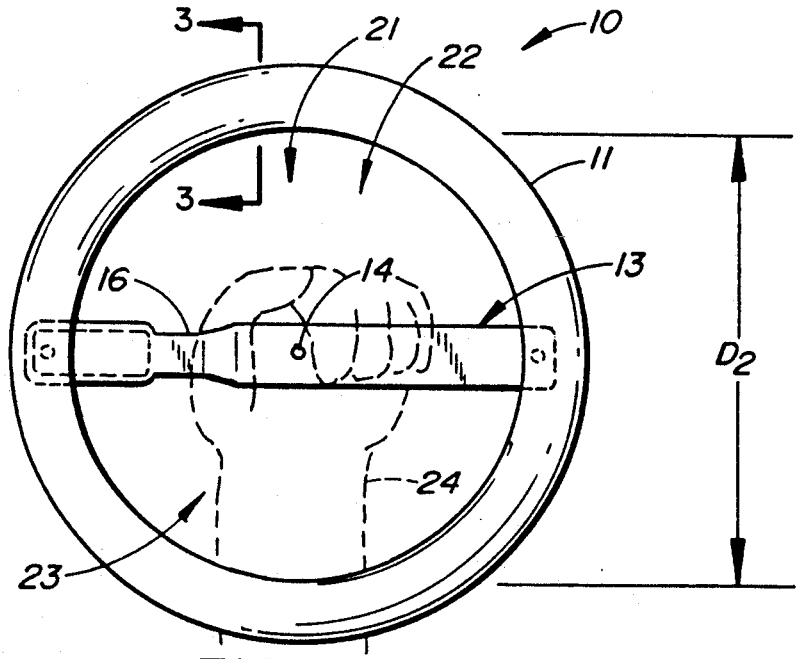
FIG. 1 is a bottom plan view of the improved oral device of the present invention that includes a simulated tooth brush interior of a teething ring illustrating a youngster's hand, in phantom gripping the handle of the former.
Figure 4:
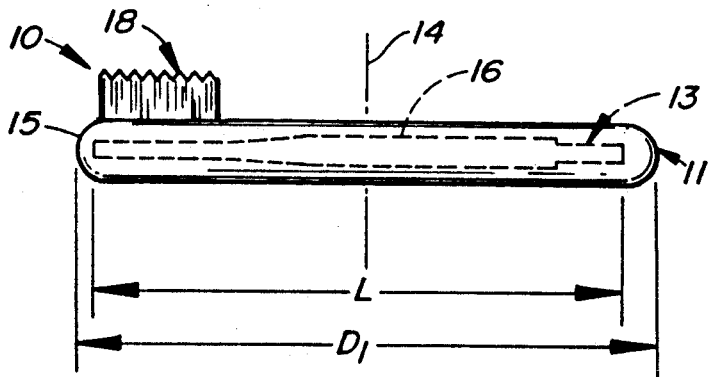
FIGS. 4 and 5 are side elevational and top plan views, respectively, of the oral device of FIG. 1.
Figure 3:
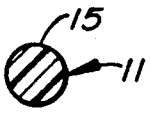
FIG. 3 is a cross-sectional view taken along line 3—3 of FIG. 1.
Figure 2:
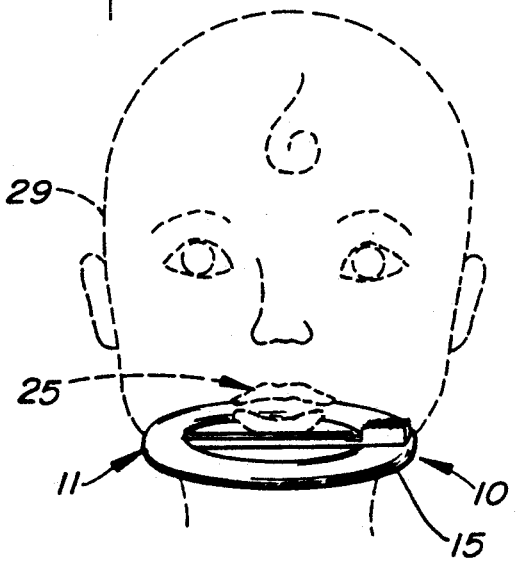
FIG. 2 is a perspective view of the oral device of FIG. 1 shown within a youngster's mouth as a teething ring.
Figure 5:
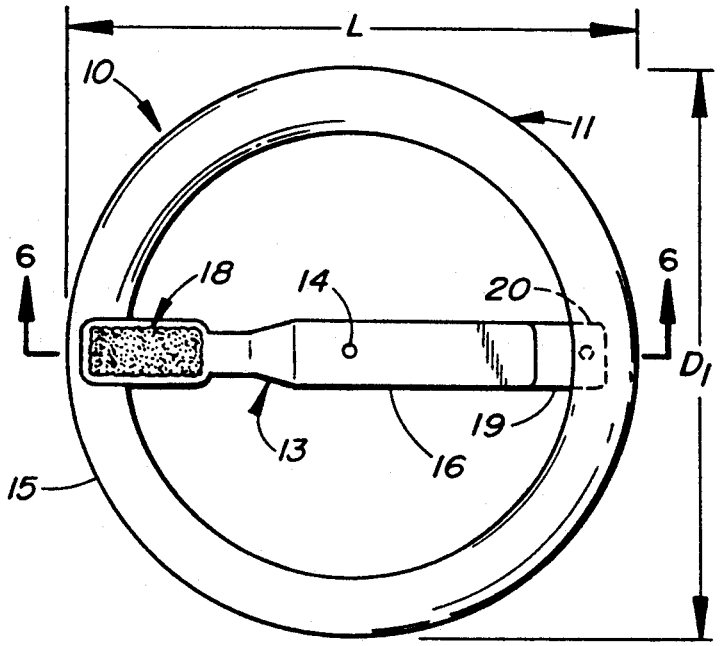
Figure 6:
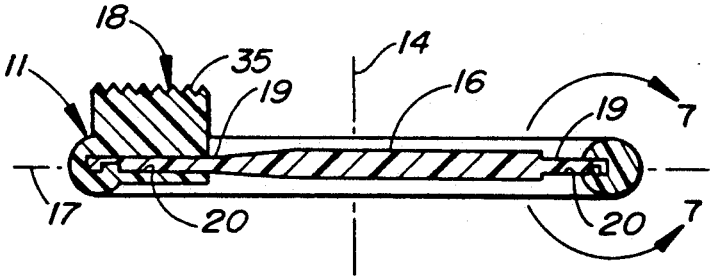
FIG. 6 is a cross-sectional view taken along line 6—6 of FIG. 5.
Figure 7:
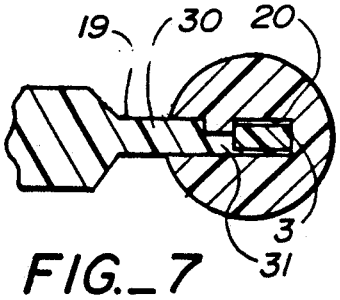
FIG. 7 is an enlarged portion of the device of FIG. 6 taken along line 7—7 thereof.

In FIGS. 1, 2 and 3, an improved oral hygiene device 10 is shown. Device 10 includes a teething ring 11 and a simulated tooth brush 13. The teething ring 11 has a central axis of symmetry 14 and is composed of arcuate linkages of circular cross section terminating in a outer circumferential arcuate surface 15 (FIG. 3).

Simulated tooth brush 13 includes a handle 16. Since the handle 16 also interiorly spans interior cavity 21 of the teething ring 11, the cavity 21 can be divided by the position of the handle 16. That is to say, the handle 16 divides the interior cavity 21 into a pair of coplanar crescent-shaped sectors 22, 23 that intersect both the handle 16 and the axis of symmetry 14. However, the interior diamter D2 of the teething ring 11 must be of sufficient magnitude that the resulting sector areas are large enough to permit a hand 24 of a youngster (not shown) to penetrate through the sectors 22, 23 and grip the handle 16 of the tooth brush 13.

An important aspect of dental hygiene is also, of course, the massaging of the youngster's gums. This aspect of the present invention is illustrated in FIG. 2. As shown, the youngster generally indicated at 29 in phantom line, has been provided with the teething ring 11 of the device 10. That is to say, at the least a portion of the circumferential surface 15 of the teething ring 11 has been place within the youngster's mouth 25. In this regard, massaging of the gums (not shown) is thus provided. In this way the gums of the youngster 29 are stimulated and pain (if present) is lessened. The later condition is particularly important when the youngster's baby teeth first penetrate the gum line.

Returning to FIG. 1, since the sectors 22, 23 permit the hand 24 of the youngster to grip the handle 16 of the device 10, there is provided an environment that the youngster can associate pleasant factors related to massaging his gums and elimination of pain to later taught techniques related to cleaning and maintaining his baby teeth. In this regard, the simulated tooth brush 13 is constructed to be of an appropriate size, shape and color that pleasant memories are easily triggered and sustained as proper cleaning technique are taught as explained below. Associative factors include: similar functionality of the handle 16 of the simulated tooth brush 13 (as well as similarity of color, size and shape) with a later-to-be-used tooth brush as described below.

FIGS. 4, 5, 6 and 7 illustrate the oral device 10 of the present invention in more detail.

As shown, the teething ring 11 of the device 10 defines an outside diameter D1 intersecting the axis of symmetry 14. The length of the tooth brush 13 is L as measured along a line normal to and intersecting the central axis of symmetry 14. In order that the simulated tooth brush 13 attach entirely within the confines of the teething ring 11 and not extend beyond the outer surface 15 (to cause injury), L must be equal to or less than outer diamter D1 of the teething ring 11.

Simulated tooth brush 13 includes handle 16 as previously mentioned. As shown best in FIGS. 5 and 6, the handle 16 is preferably of rectangular cross-section, has an axis of symmetry 17 normal to the central axis of symmetry 14 and a pair of swedged, modified end segments 19. As shown, the end segments 19 connected to diametrically-opposed, parallel slots 20 within the teething ring 11. The end segments 19 are each fitted with an opening 30 (FIG. 7) that attaches to button 31 within each slot 20. Note that the height of the button 31 is less than that of the slot 20. The width and height of each end segment 19 is also constructed to be slightly reduced between radial opening 30 and terminus 33. Hence there is adequate clearance provided to permit the handle 16 to be inserted in sequence into the slots 20. During insertion, the annular shape of the teething ring 11 is changed to oval to accommodate insertion of the handle 16.

Bristle section 18 is constructed to be integrally molded within the teething ring 11 itself. As shown, the section 18 extends from one of the slots 20 to a height beyond the normal circular cross section of the teething ring 11. Its terminating surface 35 is scalloped to resemble the surface of the bristles of an actual tooth brush as explained below.

Figure 8:
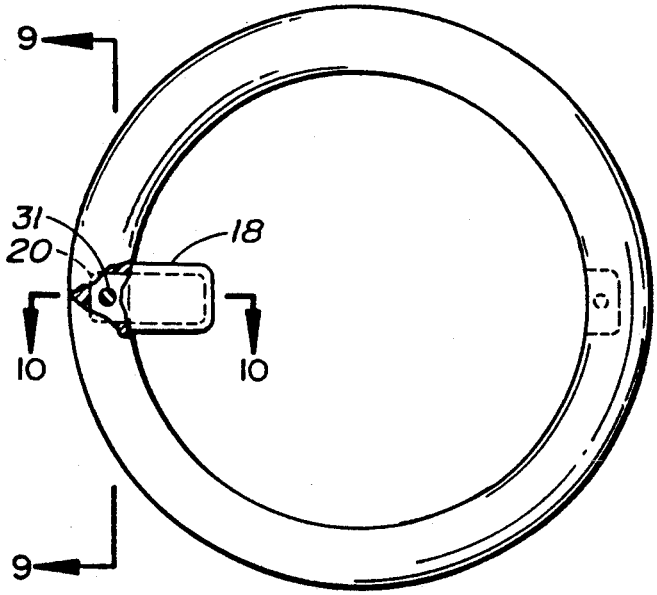
FIG. 8 is a bottom plan view of the teething ring portion of the oral device of FIG. 1 partially cut away to show internal structure.
Figure 9:
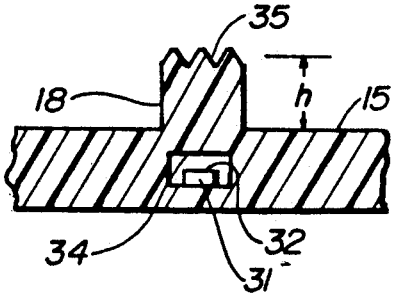
FIGS. 9 and 10 are enlarged cross sections taken along lines 9—9 and 10—10, respectively, of FIG. 8.
Figure 10:
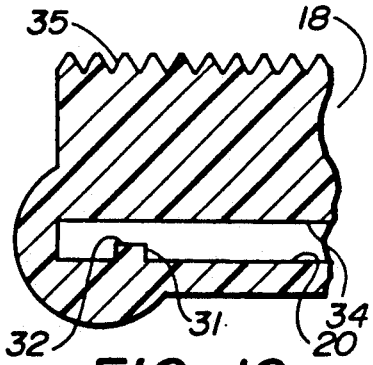

FIGS. 8, 9 and 10 illustrate bristle section 18 in more detail.

As shown, the bristle section 18 is positioned adjacent to one of the slots 20 in the teething ring 11. In more detail as shown in FIGS. 9 and 10, it extends from wall 34 of such slot 20 (shown to be adjacent to end surface 32 of button 31) to a height h beyond the circumferential surface 15 of the teething ring 11. Its terminating surface 35 is scalloped in both horizontal and vertical directions to resemble the surface of the bristles of an actual tooth brush.

Figure 11:
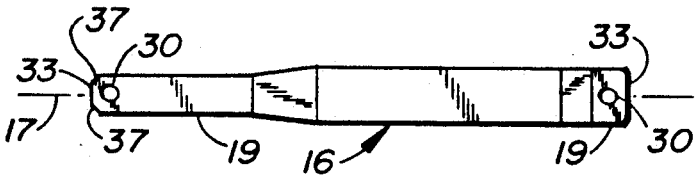
FIG. 11 is plan view of the simulated handle portion of the oral device of FIGS. 4 and 5.

FIG. 11 illustrates the end segments 19 of handle 16 in more detail.

As shown, the end segments 19 are fitted with openings 30 previously mentioned. Each opening 30 is seen to be transverse to the central axis of symmetry 17, and are sized to fit into contact about the buttons 31 (FIGS. 10 and 11) as previously mentioned. Note that the thickness of the end segments 19 are also less than that of the slot 20. That is, each end segment 19 is constructed to be slightly reduced between opening 30 and terminus 33. Furthermore, terminus 33 (associated with adjacent position to the bristle section 18) can be rounded to form a pair of forty-five degree sides 37. Hence there is both adequate clearance in height and width by the end segments 19 to easily permit their entry in sequence into the slots 20.

METHOD ASPECTS

Figure 12:
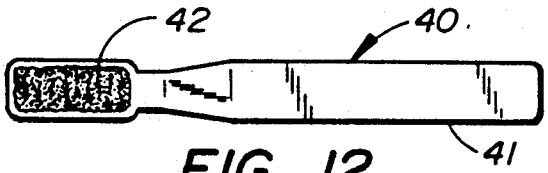
FIGS. 12 and 13 are top plan and side elevational views, respectively, of an actual tooth brush that is similar in color, size and shape to the simulated brush of the device of FIG. 1.
Figure 13:
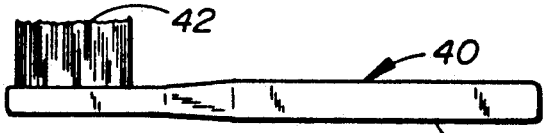

In the method aspect of the invention, the youngster is provided with an actual tooth brush of similar size, shape and color as the simulated tooth brush. As shown in FIGS. 12 and 13, such actual tooth brush 40 includes a handle 41 and a bristle section 42. Note that there is size, shape and color similitude between the tooth brush 40 and the simulated brush 13 of the oral device 10 of FIGS. 1–8. Cognitive recognition between function of the separate tooth brushes 13 and 40 are thus established in the manner previously described.

Figure 14:
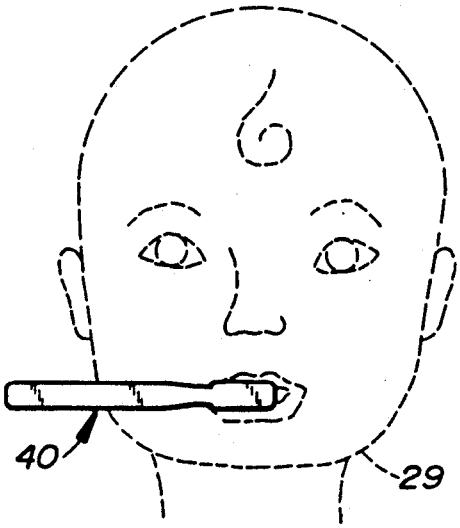
FIG. 14 is a perspective view of the brush of FIGS. 12 and 13 shown within a youngster's mouth.

Mechanics of good brushing are then taught. For example, as shown in FIG. 14, the youngster 29 is given lessons in brushing using the actual tooth brush 40 by the teacher (not shown). The youngster 29 is also allowed to carry the improved oral hygiene device 10 of FIGS. 1–8 with him during play or waking rest periods as well as enjoy benefits thereof to massage his gums. Cognitive recognition between functions of the separate tooth brushes 13 and 40 are thus established. Through repetition and reinforcement coupled with dexterity improvement through the toting of the improved device 10 of the present invention augmented by the similarities of color, size and shape of the two brushes 13, 40, a life-long habit of good oral hygiene can be firmly established.

Manufacture of the oral device 10 of the present invention preferably includes the insertion of liquid plastic into separate molds associated with the teething ring 11 and the handle 16. Since the bristle section 18 is integrally molded with the teething ring 11, the color of bristle section 18 would usually dictate the color of the latter, with the color white being preferred. However, the color of the handle 16 should contrast with the bristle section 18 so as to visually stress the actual function of the tooth brush 13, that is, reinforce the actual function of using the actual tooth brush 40. In this regard, bright, primary and secondary colors of the visual spectrum for the handle 16 having a relatively high coefficient of reflection, are preferred, e.g., red, chartreuse, orange, blue etc.

While the teething ring 11 is preferably manufactured with the bristle section 18 integrally formed therewith, the molding process can also be carried out in two stages so that different color pigments can be sequentially added to the base plastic. Result: different colors can be provided the teething ring 11 and the bristle section 18. In that way, there is better contrast between the teething ring 11 (excluding the bristle section 18) and the bristle section 18 itself. That is to say, the teething ring 11 (excluding the bristle section 18) could be neutral color, the bristle section 18 white with the handle 18 a bright color. In all cases, the color pigments must not be toxic or represent any danger to the youngster using the oral device 10 of the present invention.

Having described the present invention, the advantages can be appreciated. It should be also understood that the invention is not limited to embodiments described hereinbefore as many variations will be readily apparent to those persons skilled in the art. Thus, the invention is to be given the broadest possible interpretation with the terms of the following claims.

What is claimed is:

1. An oral hygiene device comprising a teething ring of annular shape including a pair of diametrically alligned slots and having an outside diameter D1 defining an interior cavity and a simulated tooth brush including a bristle section and a handle having an axis of symmetry normal to that of said teething ring, said handle being of a length L where L is equal to or less than D1 as well as having end segments connected to said teething ring within said alligned slots whereby said handle spans across said interior cavity of said teething ring thereby defining a pair of crescent-shaped sectors of sufficient area to permit the hand of a youngster to penetrate through the sectors and grip said handle of said tooth brush whereby said youngster can mechanically manipulate said handle of said simulated tooth brush resulting in the generation of pleasant associative factors to be augmented by later oral hygiene education involving an actual tooth brush matched at least in color to said handle of said simulated tooth brush.

2. The device of claim 1 in which said slots are each fitted with a button that penetrates a transverse opening through said end segments to thereby attach said handle relative to said teething ring.

3. The device of claim 2 in which said buttons within said slots define a height dimension that is less than that of said slots as well as being less than that of said end segments whereby adequate clearance is provided to permit said handle to be inserted in sequence into said slots.

4. Method of forming an improved oral hygiene device comprising a teething ring of annular shape having an outside diameter D1 defining an interior cavity and a simulated tooth brush that includes a bristle section and a handle having an axis of symmetry normal to that of the teething ring, comprising the steps of:

(i) inserting color-pigmented plastic into separate molds associated with the teething ring and the handle, wherein the bristle section of the simulated tooth brush is integrally molded with the teething ring, the color pigmentation being such the colors for at least the teething ring and handle are each different but the color of the handle contrasting with that of the bristle section so as to visually stress the actual function of the tooth brush during use, (ii) removing the teething ring with integral bristle section, and handle from their molds, (iii) inserting the handle into diametrically aligned slots within the teething ring wherein length L of the handle is equal to or less than the outside diameter D1 of the teething ring whereby the handle spans the interior cavity of the teething ring to thereby define a pair of crescent-shaped sectors of sufficient area to permit the hand of a youngster to penetrate through the sectors and grip said handle of said tooth brush.

5. The method of claim 4 in which step (1) is further characterized by matching the color of the bristle section with the color of the teething ring.

6. The method of claim 5 which includes coloring the bristle section and the teething ring white.

7. The method of claim 4 which includes coloring the bristle section, the teething ring and the handle each a different color.

8. The method of claim 7 which includes coloring the handle with a pigment having a high reflection coefficient.

9. The method of claim 4 which includes coloring the plastic of step (i) with a non-toxic pigment.

10. The method claim 4 in which step (iii) is further characterized by changing the shape of the teething ring to an oval shape to permit insertion of the handle into the diametrically aligned slots in the teething ring.

11. The method of teaching oral hygiene using an oral hygiene device comprising a teething ring of annular shape having an outside diameter D1 defining an interior cavity and a simulated tooth brush including a bristle section and a handle having an axis of symmetry normal to that of said teething ring, said handle also having end segments connected to diametrically-opposed, parallel slots within said teething ring thereby permitting the handle to span across said interior cavity of said teething ring wherein there is defined a pair of crescent-shaped sectors of sufficient area to permit the hand of a youngster to penetrate through the sectors and grip said handle of said tooth brush whereby a youngster can mechanically manipulate said handle of said simulated tooth brush resulting in the generation of pleasant associative factors to be augmented by oral hygiene education, comprising the steps of:

(a) providing a youngster with an actual tooth brush of at least similar color as the simulated tooth brush of the improved hygiene device;

(b) encouraging said youngster to carry the improved oral hygiene device with him during play or waking rest periods whereby cognitive recognition between functions of the separate tooth brushes are established;

(c) actually cleaning the youngster's teeth using said actual tooth brush in which the mechanics of good brushing are taught by a teacher whereby pleasant associative factors associated with step (b) are augmented by color similitude between the actual tooth brush matched to that of the handle of the simulated tooth brush.

12. The method of claim 11 with the addition of the following step:

(d) repeating the steps (b) and (c) whereby reinforcement coupled with dexterity improvement through the toting of the improved device firmly establish a life-long habit of good oral hygiene.

* * * * *